US008475630B2

(12) United States Patent
Reis et al.

(10) Patent No.: US 8,475,630 B2
(45) Date of Patent: Jul. 2, 2013

(54) RETENTION SYSTEMS AND METHODS FOR PAPERMAKING

(75) Inventors: Lynn Reis, Somerville, MA (US); Gangadhar Jogikalmath, Cambridge, MA (US); David S. Soane, Chestnut Hill, MA (US)

(73) Assignee: NanoPaper, LLC, Cambridge, MA (US)

( * ) Notice: Subject to any disclaimer, the term of this patent is extended or adjusted under 35 U.S.C. 154(b) by 361 days.

(21) Appl. No.: 12/761,620

(22) Filed: Apr. 16, 2010

(65) Prior Publication Data

US 2010/0263818 A1 Oct. 21, 2010

Related U.S. Application Data

(60) Provisional application No. 61/169,759, filed on Apr. 16, 2009.

(51) Int. Cl.
*D21H 17/33* (2006.01)
*D21H 17/35* (2006.01)
*D21H 21/30* (2006.01)

(52) U.S. Cl.
USPC ..... 162/169; 162/158; 162/162; 162/164.6; 162/168.2; 8/648; 252/301.21

(58) Field of Classification Search
USPC ..... 162/158, 162, 1, 64.1, 164.6, 164.7, 162/166, 168.1, 168.2, 169, 183–185; 252/301.21; 8/648; 544/113, 193.1–194
See application file for complete search history.

(56) References Cited

U.S. PATENT DOCUMENTS

| | | | | |
|---|---|---|---|---|
| 4,599,087 | A | 7/1986 | Heller et al. | |
| 4,695,405 | A | 9/1987 | Harnisch et al. | |
| 4,718,918 | A | 1/1988 | Heller et al. | |
| 6,426,382 | B1 | 7/2002 | Farrar et al. | |
| 6,918,995 | B2 * | 7/2005 | Frolich et al. | 162/164.5 |
| 6,951,671 | B2 * | 10/2005 | Mukherjee et al. | 428/32.12 |
| 6,969,444 | B2 * | 11/2005 | Linhart et al. | 162/135 |
| 7,060,201 | B2 | 6/2006 | Farrar | |
| 7,179,779 | B1 | 2/2007 | Hauser et al. | |
| 2003/0134959 | A1 | 7/2003 | Hancock et al. | |
| 2004/0016528 | A1 * | 1/2004 | Varnell | 162/164.6 |
| 2004/0154764 | A1 * | 8/2004 | Blum et al. | 162/135 |

FOREIGN PATENT DOCUMENTS

WO 9967317 A1 12/1999

* cited by examiner

*Primary Examiner* — Mark Halpern
*Assistant Examiner* — Dennis Cordray
(74) *Attorney, Agent, or Firm* — Elmore Patent Law Group, P.C.; Mahreen Chaudhry Hoda, Esq.

(57) ABSTRACT

Compositions and methods of producing an optically-enhanced paper-based material are disclosed. The composition can include an optical brightening agent and an additive having an aromatic portion, where the aromatic portion is associated with an optical brightening agent. The paper-based material can exhibit a higher capacity for the optical brightening agent relative to a paper-based material that lacks the additive. Techniques for increasing optical brightening agent retention in a paper-based material are also disclosed. The techniques include using an additive having an aromatic portion, where the aromatic portion associates with an optical brightening agent so that the retention of the optical brightening agent is improved.

32 Claims, 6 Drawing Sheets

RETENTION SYSTEMS AND METHODS FOR PAPERMAKING

CROSS REFERENCE TO RELATED APPLICATIONS

The present application claims the benefit of a U.S. provisional patent application bearing Ser. No. 61/169,759, entitled "Retention Systems and Methods for Papermaking," filed Apr. 16, 2009. The entire contents of the provisional application are hereby incorporated herein by reference in their entirety.

FIELD OF THE APPLICATION

This application relates generally to making fibrous products with enhanced brightness, e.g., by providing compositions and products capable of increasing the retention of optical brightening agents (OBAs).

BACKGROUND

For the purpose of achieving a maximum degree of brightness, the paper industry has various methods at its disposal, such as selecting very bright paper raw materials, bleaching the raw material, and using fillers or white pigments, tinting dyes and/or optical brighteners. The optical brighteners do not hide the conventional yellowish shade of the paper by subtraction but substitute for the lack of remission by emitting additional fluorescent light. Optical brighteners shift the shade of the brightened material, e.g., from yellow towards blue, and the increase in emission results in an increase in brightness.

In the production of paper, it is usual to employ retention agents, dewatering agents, and/or fixatives to improve the speed of production or other properties and yield of the product. These adjuvants are mostly of cationic character. OBAs, by contrast, can be anionic in character. In paper processing, it is possible that the anionic and cationic substances (such as the retention agent and the OBA) could interact and form an undesirable precipitate. Furthermore, ionic interaction of OBAs with other substances such as retention agents can cause a discoloration in the appearance of the paper, making the product appear more "green" than if the OBA-containing paper did not involve a substance undergoing an ionic interaction with the OBA. In addition, certain OBAs do not bond well to the paper fibers, and are poorly retained.

There remains a need in the art, therefore, for a retention agent system that enhances the attachment of OBAs to paper fibers without impairing other desirable characteristics of the final paper product. Moreover, there exists a need in the art to improve OBA retention so as to reduce the loss of these expensive agents during paper processing.

SUMMARY

Some embodiments of the present invention are directed to paper-based materials such as those that exhibit optical enhancement. Such materials can include an optical brightening agent and an additive such as one having an aromatic portion that can associate with the optical brightening agent. For instance, the aromatic portion of the additive can substantially associate with the optical brightening agent by a non-ionic interaction. In some instances, the paper-based material does not exhibit a substantial color shift relative to a paper-based product containing the optical brightening agent sans the additive. The paper-based material can exhibit a higher capacity for the optical brightening agent relative to a paper-based material lacking the additive.

In some embodiments, the paper-based material includes a fibrous matrix and/or filler particles or other components which may be found in paper products. In some instances, the additive comprises at least one fiber-associating functionality capable of associating the additive with the fibrous matrix, or a functionality capable of associating with the filler particle. Such additives can optionally render the fibrous matrix, and/or a filler particle, substantially hydrophobic. With respect to particles, a functionalized particle can exhibit association with the fibrous matrix. Such particles can be functionalized with a polycation, which can act to aid binding of an aromatic-containing polymer to the particles. Polycation functionalization can also be utilized with the fibers of a paper-based material.

Additives for use with embodiments of the invention can comprise either a non-polymeric containing additive and/or a polymeric containing additive. For instance, a polymer for use as at least a portion of an additive can include a plurality of aromatic-containing units such as a styrenic unit that can be optionally substituted. Polymers can include homopolymers and/or copolymers (e.g., copolymers containing any of styrene maleimides and styrene maleic anhydrides portions). In some instances, the additive is chosen such that the additive does not substantially quench fluorescence of the optical brightening agent (e.g., the additive substantially lacks nitro groups).

Other embodiments of the present invention are drawn to methods for increasing optical brightening agent retention in a paper-based material. An additive comprising an aromatic portion can be utilized. The aromatic portion can associate the optical brightening agent with the additive (e.g., inducing pi-bond interactions between the additive and the optical brightening agent), which can thereby increase retention of the optical brightening agent in the paper-based material.

Additives for use with the methods can include any one or combination of the features discussed herein. For example, the additive can interact with an optical brightening agent by a non-ionic interaction, and/or prevent a substantial color shift in the paper-based material due to the presence the additive and the optical brightening agent. In some instances, the pH of a papermaking mixture can be changed to increase attraction between the additive and a fibrous matrix and/or fibers of the mixture. When an additive is utilized, the additive can act to increase the hydrophobicity of a fiber and/or a fibrous matrix, either before or after the additive associates with the optical brightening agent. In some instances, the additive is attached to at least a portion of a plurality of particles to form functionalized particles, which can be contacted with the optical brightening agent. Such functionalized particles can be adhered to fibers of the paper-based material (e.g., using a polycation) before or after contacting the functionalized particles to the optical brightening agent.

DETAILED DESCRIPTION

Figure 1:
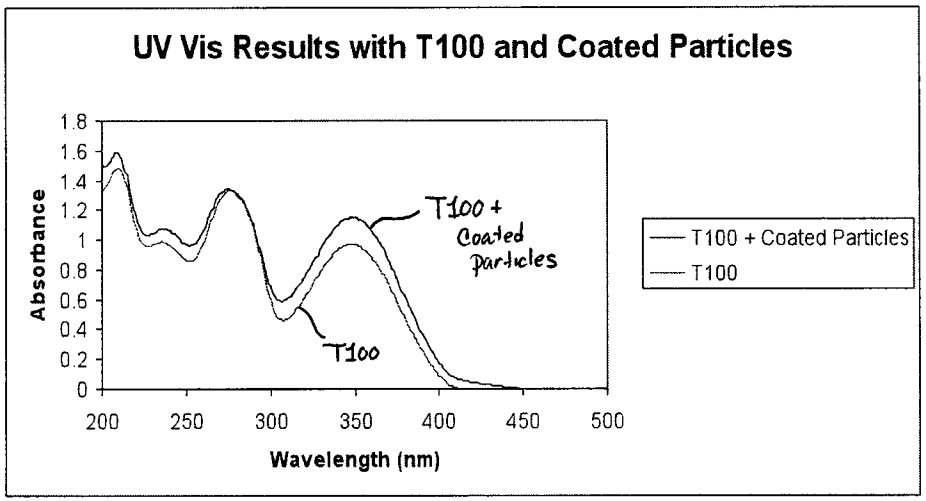
FIG. 1 presents a graph showing UV Vis results.

Some embodiments of the present invention are directed to systems, compositions, and methods related to enhancing the brightness of paper-based materials, for instance by increasing the retention of optical brightening agents (OBAs). Embodiments of the invention are also directed to techniques that can enhance the performance of OBAs in paper-based materials, for example by reducing the effects of precipitation and/or color shifting associated with conventional retention agents used with OBAs in paper-based materials Previous retention aids utilize a cationic charge to provide an ionic interaction with the anionic charges of some OBAs to aid retention. Such ionic binding, however, has been found to induce precipitation of the OBA, resulting in decreased dispersal of the OBA in the paper which can also affect the mechanical properties of the final paper product. As well, the ionic binding is believed to result in a color shift in the paper-based material. For instance the ionic bonding of the OBA with a polymer bearing cationic charge can result in a change in the absorption spectra of the paper and/or the fluorescence spectra of the OBA in the final paper product, making the paper-product appear more green than a paper product that contains an OBA but that lacks an additive having a cationic charge interacting with the OBA. Such discoloration of the final paper product is clearly undesirable.

Some embodiments can aid to alleviate one or more of these problems by using additives which can associate with OBAs in a non-ionic manner. For example, aromatic portions of an additive can be used to associate the additive with the OBAs. Without necessarily being bound to any particular theory, it is believed that the aromatic portions of the additive can associate with the aromatic structures of an OBA by the use of pi-pi stacking involving flat aromatic structures with pi electron clouds that overlap with neighboring aromatic structures resulting in strong interactions between them. The use of this association mechanism, while substantially suppressing ionic interactions between an OBA and an additive, can reduce problems associated with precipitation and/or color shifting inherent in the prior art.

DEFINITIONS

As used in the present application, the following terms shall have the meanings indicated unless the context otherwise requires:

The term "aromatic" as used herein includes entitles having aromatic rings such as 5-, 6-, and 7-membered single-ring aromatic groups that may include from zero to four heteroatoms. Examples include benzene, pyrrole, furan, thiophene, imidazole, oxazole, thiazole, triazole, pyrazole, pyridine, pyrazine, pyridazine and pyrimidine, and the like. Those aromatic groups having heteroatoms in the ring structure can also be referred to as "aryl heterocycles" or "heteroaromatics." Heteroatoms are atoms other than carbon or hydrogen. In some instances, heteroatoms can be any one of boron, nitrogen, oxygen, phosphorus, sulfur and selenium.

The aromatic ring can be substituted at one or more ring positions with substituents, for example, halogen, azide, alkyl, aralkyl, alkenyl, alkynyl, cycloalkyl, hydroxyl, alkoxyl, amino, nitro, sulfhydryl, imino, amido, phosphate, phosphonate, phosphinate, carbonyl, carboxyl, silyl, ether, alkylthio, sulfonyl, sulfonamido, ketone, aldehyde, ester, heterocyclyl, aromatic or heteroaromatic moieties, —$CF_3$, —CN, or the like. In some instances, the substitutions are chosen such that the aromatic ring will not adversely interact with the optical properties of the optical brightening agent (e.g., the substituents do not substantially include nitro groups).

The term "aromatic" also includes polycyclic ring systems having two or more cyclic rings in which two or more carbons are common to two adjoining rings (the rings are "fused rings") wherein at least one of the rings is aromatic, e.g., the other cyclic rings can be cycloalkyls, cycloalkenyls, cycloalkynyls, aryls and/or heterocyclyls.

The term "associate," when utilized with respect to a plurality of entities, refers to a tendency of the entities to be attracted to one another. While binding and/or contact between the entities is not required, the term associate can be inclusive of these as well. The mechanism of association can be any appropriate force that tends to cause the entities to come together. Non-limiting examples include ionic forces (e.g., electrostatic interactions), van der Waals forces, hydrogen bonding, covalent bonding, forces related to the transport of the entities, other intermolecular and macroscopic forces.

The term "fiber" refers to a particle in which one dimension of the particle is much larger than at least one other dimension (e.g., the other two dimensions) of the particle. For instance, the fiber can have a length that is at least about 2, 3, 4, 5, 7, or 10 times longer than a shorter cross-sectional dimension. In some instances, the cross-sectional dimension can be smaller than about 1 mm or 100 microns. The composition of the fibers can include either or both natural and synthetic components. In some instances, the fibers, which can be part of a papermaking composition and/or a fibrous matrix, can be hydrophilic and/or bear a net charge (e.g., be anionic) in the fibers native state. An example would be cellulosic-based fibers.

As used herein, the term "fibrous matrix" refers to a manufactured sheet, web or batt of directionally or randomly orientated fibers, bonded by friction and/or cohesion and/or adhesion, for example, mechanically, chemically, thermally or electrostatically, or intersecting with each other at predetermined positions of contact by knitting, weaving, and the like. Examples of a fibrous matrix would include papers, textiles, or other nonwoven or woven materials containing natural or synthetic fibers.

As used herein, the term "functionalized" refers to an entity, such as a filler particle or fiber, that has been surface functionalized with groups that can interact with other components of a paper-based material. or in a papermaking mixture. For example, a cellulosic-based fiber or filler particle can be functionalized with groups that tend to associate with other entities, such as OBAs, via covalent bonding, hydrogen bonding, electrostatic interactions, van der Waal's forces, and other intermolecular forces. Functionalization may be achieved by precipitating or depositing a thin polymer (e.g., copolymer) layer with native reactive side groups on the particle, or by the use of coupling agents. As an example, a particle can be functionalized by attaching a polyamine onto the surface of the particle using adsorption or precipitation. In embodiments, a polyamine such as chitosan can be adsorbed onto the surface of particles, with the particles then possessing amine functionality.

The phrase "optical brightening agents" (OBAs) refer generally to compounds that fluoresce in the blue spectral range upon activation by shorter wavelengths of light. For instance, in the chemical industry some OBAs are excited (activated) by wavelengths of light in the ultraviolet (UV) wavelength range of 320 to 410 nm (typically in the near-ultraviolet (UV) range (360 to 365 nm)) and re-emit fluorescence light in the spectral range between 420 to 550 nm. The maximum of the fluorescence spectrum can lie between 430 and 440 nm. In the industry, OBAs have been classified, based on structure and properties, into some 11 major chemical families, each containing numerous sub-families, hundreds of compounds, and thousands of different formulations.

OBAs typically incorporate at least one aromatic structure, and can often utilize highly-substituted aromatic structures that contain many double bonds which can be activated by UV light. Exemplary OBAs include, without limitation, agents such as stilbenes and stilbene derivatives (e.g., sulfonated stilbene), coumarins, diazols, imidazolines, imidazolines, triazoles, benzoxazoles, and the like. Specific examples include Exemplary OBAs include, without limitation, agents such as stilbenes and stilbene derivatives (e.g., sulfonated stilbene), coumarins, diazols, imidazolines, imidazolines, triazoles, benzoxazoles, and the like 4,4'-bis-(triazinylamino)-stilbene-2,2'-disulfonic acids, 4,4'-bis-(triazol-2-yl) stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides.

As used herein, the terms "paper" and "paper-based material" may be applied to a wide variety of sheet-like masses, molded products, and other substrates fabricated from fibers derived from biological sources (e.g., fibrous cellulosic material), which may optionally include other fibrous elements derived from mineral sources (e.g., asbestos or glass) and/or from synthetic sources (e.g., polyamides, polyesters, rayon and polyacrylic resins). To make paper from wood cellulosic fibers, these fibers are typically first mechanically and/or chemically processed to form an aqueous slurry of pulp. The slurry can then introduced onto a screen-like device to remove water and to allow the fibers to consolidate. Thereafter, the consolidated material may be pressed or dried further to produce a dry roll or sheet of finished paper.

For commercial papermaking operations, a device like the Fourdrinier machine or the cylinder machine may be used to process the pulp into paper. The feed or inlet onto the papermaking machine is the aqueous slurry of pulp fibers, as described above. This part of the process is known as the "wet end." In the wet end, the pulp may be mixed with other additives in a water suspension, and the suspension is then subject to mechanical and chemical processes such as beating and refining to improve the interfiber attachments of the cellulose fibers, and to achieve other desirable characteristics in the finished paper sheet.

Other components introduced during papermaking may include pigments such as titanium dioxide, mineral fillers such as clay and calcium carbonate, and other materials that are designed to improve the performance attributes of the finished product, such as brightness, opacity, smoothness, ink receptivity, fire retardance, water resistance, bulk, and the like. In embodiments, the paper-based material can include particles associated with the fibers, e.g., fillers that are associated with cellulosic fibers in papermaking.

As used herein, filler particles, or other particles, suitable for use papermaking or a final paper product can include mineral particles such as calcium carbonate, dolomite, calcium sulfate, kaolin, talc, titanium dioxide, silica, aluminum hydroxide, and the like. Particles can also include polymeric materials, solid or porous, which can optionally be crosslinked. In embodiments, such particles can be embedded in the fibrous web of a paper product as it is derived from wood pulp slurry to improve the quality of the cellulose-based paper.

As utilized within the present application, the term "polymer" refers to a molecule comprising repeat units, wherein the number of repeat units in the molecule is greater than about 10. A molecule having fewer than about 10 repeat units can be termed an "oligomer." Oligomers can also be defined as having at least 5 repeat units (e.g., adjacently connected). Repeat units can be adjacently connected, as in a homopolymer. The units, however, can be assembled in other manners as well. For example, a plurality of different repeat units can be assembled as a copolymer. If A represents one repeat unit and B represents another repeat unit, copolymers can be represented as blocks of joined units (e.g., A-A-A-A-A-A . . . B-B-B-B-B-B . . . ) or interstitially spaced units (e.g., A-B-A-B-A-B . . . or A-A-B-A-A-B-A-A-B . . . ), or randomly arranged units. In general, polymers include homopolymers, copolymers (e.g., block, inter-repeating, or random), crosslinked polymers, linear, branched, and/or gel networks, as well as polymer solutions and melts. Polymers can also be characterized as having a range of molecular weights from monodisperse to highly polydisperse.

As used herein, the term "polyamine" can include any polymer (e.g., homopolymer or copolymer) that has at least a portion of its repeat units containing an amine (quaternary, ternary, secondary, or primary). In embodiments, the polyamine can desirably contain some repeat units with primary amines due to the reactivity of a primary amine. The polymer molecular weight can range from 1,000 up to 10,000,000 daltons but it is preferable to be between 10,000 to 500,000 daltons. In embodiments, the polyamine can be a polymer comprising chitosan or polyethyleneimine. In embodiments, a chitosan polymer can comprise a certain portion of higher molecular weight chitosan, i.e., chitosan with a viscosity of at least 800 cp when in a 1% acetic acid solution. In embodiments, the amount of higher molecular weight chitosan can be greater than 10%, greater than 20%, or greater than 30%. Those of skill in the art will appreciate that for certain polymers, e.g., chitosan, an exact molecular weight may not be available, because such structures are defined by viscosity rather than molecular weight.

Paper-Based Compositions and Methods

Some embodiments of the present invention are directed to systems, composition, and methods related to improving paper-based materials that utilize OBAs. In such embodiments, an additive can be utilized that can associate with an OBA to aid retention of the OBA. In many instances, such additives can be utilized in a manner in which precipitation of the OBA and/or an adverse color shift (e.g. green tinted discoloration) of the final paper can be avoided. For example, the additive can associate with the OBA by a substantially non-ionic interaction. In general, many embodiments utilize additives that allow an OBA to provide at least some degree of optical brightening. Accordingly, some embodiments can exclude the use of additives that provide a substantial degree of quenching to the fluorescence of the OBA (e.g., additives that include nitro groups that can act to quench an OBA's fluorescence).

In some embodiments, the additive includes an aromatic portion, i.e., the additive includes at least one aromatic group. The aromatic portion of the additive can associate with an OBA, which can aid retention of the OBA in a paper-based product relative to a product that lacks the use of the additive. Accordingly, the additive can be exposed to an environment to suppress a potential ionic interaction with an OBA, e.g., an additive is exposed to a high pH environment which can cause a cationic additive to become anionic in nature). In some instances, the additive can also associate with other components of a paper-based material, such as the fibers of a fibrous matrix and/or filler particles, which can aid ultimately aid retention of the OBA.

Additives having an aromatic portion can include a large range of entities such as a non-polymeric entities bearing at least one aromatic group (e.g., an oligomer). In some particular embodiments, the additive is a polymer having an aromatic portion. Polymers (e.g., copolymers) having an aromatic portion are also referred to as aromatic polymers. Examples of aromatic polymers include, without limitation, polymers having an aromatic ring structure in the backbone (including a heterocyclic polymer) or as a side group (e.g., polystyrenes). In some embodiments, the additive is a copolymer a plurality of optionally substituted styrenic units.

For instance, in some embodiments, styrene maleimide ("SI") copolymers can be employed in a OBA retention system. Polymers made with styrene and maleimide monomers (i.e., SI polymers) can be solubilized in acidic aqueous solutions and can possess cationic charges. The cationic groups of a SI polymer can bond electrostatically to fibers in a fibrous web, for example, to anionic, hydrophilic cellulose fibers, or can bond to anionic filler particles. Alternatively, a SI polymer can be precipitated onto a substrate such as a fibrous web or a filler particle by changing the pH of the solution. By increasing the pH, the SI will precipitate to enable even higher retention of the polymer onto a surface. This is a reversible process and the SI can also be resolubilized by again lowering the pH to a sufficient level. In such embodiments, the increase in pH can suppress the cationic nature of a polymer or additive, making it more susceptible to association with an aromatic group (e.g., aromatic portion of an OBA) via pi-pi interactions.

In certain embodiments, a SI polymer can be precipitated directly onto hydrophilic fibers (e.g., cellulose fibers). For example, this can be done in the wet end of the papermaking process. Once precipitated onto fibers in the wet end, the presence of SI functionalizes a fibrous matrix into a hydrophobic fibrous web (i.e., a paper product) due to the aromatic groups of the polymer.

In embodiments, an additive that increases the hydrophobicity of the cellulose fibers in papermaking can help in the dewatering process to produce the paper sheet, or can help reduce water uptake in paper production, reducing the need for additional sizing agents. For example, different configurations of SI polymers can be used for these applications, e.g., where the styrene to maleimide ratio is varied, creating either more aromatic groups or maleimide groups on the surface of the fibers. The additional aromatic groups can cause the substrate to exhibit increased hydrophobicity. In addition, the aromatic groups provide attachment sites for OBAs that can associate with them via the pi-pi stacking, as described above.

In alternate embodiments, an additive having an aromatic portion can exhibit a cationic charge, and can be precipitated onto particles such as filler materials. Exemplary particle materials include precipitated calcium carbonate ("PCC") or silica to form functionalized fillers. As an example of the use of particles, SI can be precipitated onto filler materials to form functionalized fillers. Such functionalized fillers, bearing for example SI on their surfaces, act as attachment points for the aromatic OBAs. In certain instances, the functionalized fillers can be added to the pulp slurry prior to adding the OBA. In other instances, the functionalized fillers can be combined with the OBA before contacting the fibers to allow more time for association, and to permit a one-step process. Presently, many paper additives have to be added to the papermaking process separately from the OBAs in order to reduce the effects that they might have on the OBA, for example, greening of the OBA and paper product due to cationic additives. A one-step process using functionalized fillers can enhance efficiency of papermaking without introducing color distortion.

While embodiments of the present invention can be exemplified by the use of a SI polymer, it is understood that the scope of aspects of the invention are not necessarily limited to the use of a SI polymer. Indeed, other types of additives having aromatic portions can act to adhere to paper or papermaking component(s) (e.g., by ionic interactions and/or thermodynamic considerations) to aid in retention of OBAs in a manner similar to that described by the use of SI polymers.

For instance, other polymers containing aromatic portions, in combination with a binding agent, can be used to form retention systems/additives for OBAs on fibrous matrices. As an example, styrene maleic anhydride ("SA") copolymers can be used for these purposes. A SA polymer does not typically exhibit pH-mediated precipitation onto surfaces. Using an additional binding agent as part of an additive, such as a polycation (e.g., a polyamine), however, SA can be associated with a filler material or with a fibrous matrix. For instance, chitosan or some other polycation can be used to coat the filler material or the fibrous matrix, either by pH-mediated precipitation or by electrostatic attraction (with PCC as the filler, for example).

In one example, once the surface of the filler material or the fibrous matrix is coated with chitosan, the amine groups of the chitosan layer can react with the anhydride groups of the SA to associate the SA with the material or matrix. Cationically functionalized particles can also act to help retain the filler in a paper product, e.g., by contacting the cationically functionalized filler with fibers before interaction with the SA or using a stoichiometrically smaller amount of SA to retain the presence of some cationic groups on the filler for interaction with the fibers.

The particles or fibers bearing the additive can then be associated with OBAs in a manner similar to particles or fibers bearing SI, as described above (e.g., through aromatic interactions). In such a circumstance, the additive can act to shield the OBAs from the cationic binding agent to substantially reduce ionic interactions with the OBAs. As previously alluded to, cationically-functionalized (e.g., chitosan coated) fillers or fibers that associate with OBAs in an ionic manner can lead to undesirable color shifts in the final paper product. In contrast, fillers or fibers that use a polycation binding agent like chitosan to anchor SA or similar aromatic-containing agents to interact with an OBA (e.g., using pi-pi bond stacking) can result in a paper product without color alteration.

EXAMPLES

Materials

SMA® 1000I, Sartomer, Exton, Pa. (styrene maleimide copolymer)

SMA® 20001, Sartomer, Exton, Pa. (styrene maleimide copolymer)

SMA® 30001, Sartomer, Exton, Pa. (styrene maleimide copolymer)

Chitosan CG10, Primex, Siglufjordur, Iceland

Chitosan CG110, Primex, Siglufjordur, Iceland

SMA® 1000P, Sartomer, Exton, Pa. (styrene maleic anhydride copolymer)

Leucophor A Liquid, Clariant, Charlotte, N.C. (disulfonated stilbene based compound)

Leucophor FTS Liquid, Clariant, Charlotte, N.C. (cationic stilbene derivative)

Leucophor T100, Clariant, Charlotte, N.C. (tetrasulfonated stilbene based compound)

Tinopal SPPZ, (Hexasulfonated stilbene based compound) Ciba, Tarrytown, N.Y.

ViCALity ALBAGLOS USP/FCC Precipitated Calcium Carbonate, Specialty Minerals, Bethlehem, Pa.

Silica, fumed, 7 nm, Sigma Aldrich, St. Louis, Mo.

Hydrochloric Acid, ACS reagent, Sigma Aldrich, St. Louis, Mo.

Sodium Hydroxide Pellets, ACS reagent, Electron Microscopy Science, Hatfield, Pa.

Example 1

Water Solubility of SI

SI, at three different ratios of styrene to maleimide (SMA® 1000I, SMA® 2000I, and SMA® 30001) was added to water with amounts of 1M HCl to solubilize it. A pH of 4-4.5 was seen to create an aqueous solution of SMA® 1000I, SMA® 2000I, and SMA® 30001. These results are consistent with the statements in Sartomer Application Bulletin 4957 "SMA® Imide Resins SMA® 1000I, 2000I, 3000I, and 4000I", that a pH of 4.5 is required for solubilizing the polymers. Each aqueous solution was then titrated using a base until the polymer precipitated out of the solution, typically at a pH of about 8. In certain Examples, 0.1M NaOH was used as the base for this step of the process; in other Examples, other molar concentrations of NaOH base were used, all as described below. Acid was then added, lowering the pH and again solubilizing the SI.

Example 2

Preparation of Chitosan Solution

A chitosan solution of CG10 was prepared by dispersing CG10 in deionized water and adding 1M HCl until the chitosan was dissolved. The final pH was approximately 3.5. Chitosan solutions were then further diluted with deionized water to obtain the concentrations set forth in the Examples below.

Example 3

Effect of Chitosan and SI on OBA Optical Properties

Chitosan CG10 and CG800 were prepared according to the method of Example 2. Samples were prepared at two different pH levels, one where chitosan is protonated and one where it is deprotonated. Additionally two concentrations of chitosan were used, 0.01% and 0.004%. Two orders of addition of the chitosan to the OBA solution were compared. One was done where a 0.01% solution of Leucophor T100 OBA was prepared and subsequently the pH was adjusted with 0.1M NaOH. Chitosan CG10 was added afterwards to see how much it would interact with the OBA. In another experiment, chitosan CG800 was added first to the water, then the pH was adjusted with 0.6M NaOH, and finally the OBA was added. These two experiments were repeated using 1% aqueous SMA® 1000I instead of chitosan. The solutions were tested using UV/Vis spectroscopy to observe any shift in peak absorption wavelengths. The results are shown in Table 1 below.

TABLE 1

| Additive | Concentration | pH | Additive in Before or After OBA? | Peak Shift |
|---|---|---|---|---|
| Chitosan | 0.01% | 3.50 | Before | 33 |
| Chitosan | 0.01% | 8.50 | Before | 14 |
| Chitosan | 0.004% | 4.00 | Before | 33 |
| Chitosan | 0.003% | 9.00 | Before | 6 |
| SI | 0.01% | 4.50 | Before | 12 |
| SI | 0.01% | 10.25 | Before | 3 |

TABLE 1-continued

| Additive | Concentration | pH | Additive in Before or After OBA? | Peak Shift |
|---|---|---|---|---|
| SI | 0.004% | 4.50 | Before | 13 |
| SI | 0.004% | 10.25 | Before | 4 |
| Chitosan | 0.01% | 3.50 | After | 35 |
| Chitosan | 0.01% | 10.00 | After | 32 |
| Chitosan | 0.004% | 3.50 | After | 33 |
| Chitosan | 0.003% | 9.50 | After | 29 |
| SI | 0.01% | 4.50 | After | 12 |
| SI | 0.01% | 10.00 | After | 3 |
| SI | 0.004% | 4.50 | After | 11 |
| SI | 0.003% | 10.00 | After | 3 |

The experiments above show that the order of addition is significant for the chitosan and not important for the SI. Additionally, due to its cationic nature, the chitosan affects the peak absorbance of the OBA no matter what the order of addition, resulting in an undesirable color shift. These results indicate that cationic polymers used as retention aids can affect the OBA performance.

Example 4

UV Vis of SA/Chitosan/PCC with OBA

Particles coated with chitosan were prepared in the following manner. First, PCC particles were dispersed in water at a 20% concentration. A solution of chitosan CG110 at 2% concentration was added to the slurry until the chitosan was 1% of the weight of the PCC. The high pH of the PCC in the solution was sufficient to precipitate the chitosan out of solution onto the PCC particles. After forming a surface layer of chitosan on the PCC particles, we added them into acetone at a 1% concentration and dispersed them for approximately 20 minutes. SMA® 1000P (a styrene maleic anhydride copolymer) at a weight equivalent to 1% of the uncoated particle weight was then dispersed into this system and mixed for several hours to allow it to react with the chitosan-coated particles. The particles were then filtered out of the system, rinsed, and dried. Solutions were then prepared with an OBA, 0.01% T100, combined with 0.1% of the functionalized particles, and absorbance was measured as a function of wavelength, using the UV/VIS spectrometer. The measurements using the functionalized particles were compared to measurements made using a 0.01% solution of Leucophor T-100 in water. The results are illustrated in FIG. 1. The peak wavelength for absorbance was the same for both solutions, indicating negligible color shift.

Example 5

Retention Studies of SI onto Fibers

SI can be adsorbed onto cellulose fibers by controlling the pH. Experiments were conducted to determine optimal retention of SI onto the cellulose fibers by adding varying amounts of base to raise the pH of SI solutions prepared according to the methods set forth in Example 1. Retention of the SI was correlated with the measured hydrophobicity of the samples: where hydrophobicity is higher, the retention is better. In this Example, small handsheets were prepared by combining 0.075 g dry weight of pulp in 75 mL of water and adding 75 μL of 1% SI in water solution. Varying amounts of base were added and a comparison was made of the subsequent hydrophobicity of the sheets as well as the zeta potential of the filtrate from preparing the sheets. Zeta potential measurements indicated the shift in the cationic nature of the polymer remaining in the filtrate; it is understood that charging the cationic imide group at low pH is required for polymer stability, and that the zeta potential measurement correlates with the point at which the polymer can precipitate out of solution.

Figure 2:
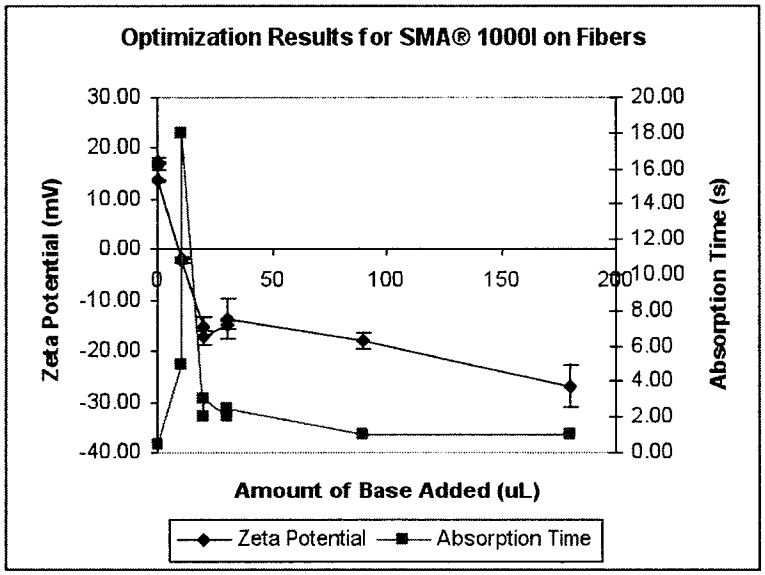
FIG. 2 presents a graph showing optimization results.
Figure 3:
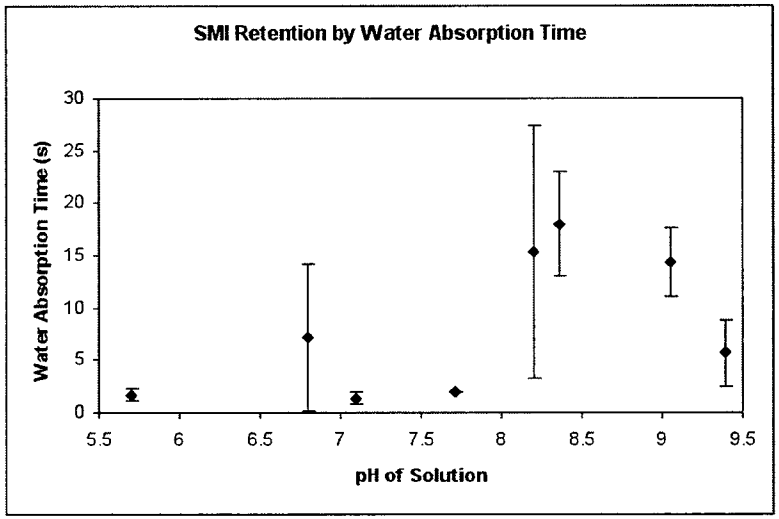
FIG. 3 presents a graph showing SMI retention.

Hydrophobicity tests were done on pulp samples with SMA® 1000I, 2000I, and 3000I at 1% concentration of the fiber weight. Characterization of hydrophobicity was done by adding a 15.44 water drop onto the paper and measuring the time for it to absorb. Higher times indicate an increased hydrophobicity and correlated with an increased styrene content on the paper. Results are shown in FIGS. 2 and 3. As shown in the graphs, the highest hydrophobicities were seen for samples prepared with a pH of 8 or higher for samples with SMA® 1000I. The zeta potential of the filtrates was generally around 0 for optimal samples. A chart can be seen for the SMA® 1000I below comparing the change in zeta potential with increasing base and the change in absorption time.

Example 6

Brightness of SI and Tetrasulfonated OBA on Fibers

A matrix of experiments was done to test the effect of SI on brightness. The concentrations of SI and OBA were varied. Testing was done using an ISS PC1 Photon Counting Spectrofluorimeter to determine emission spectra for the samples. The intensities at 457 nm were compared.

Small handsheets were prepared by combining 0.075 g dry weight of pulp in 75 mL of water and varying amounts of 1% SI in water solution. Both SMA® 1000I and SMA® 3000I were used. Base was added to adjust the pH of the solution to precipitate the polymer. Finally a set amount of 1% Leucophor T100 (OBA) was added to the slurry and a handsheet was prepared. The results are presented below in Table 2.

TABLE 2

| Sample | OBA Concentration (by fiber weight) | SI Type | SI Concentration (by OBA weight) | Intensity | Error |
|---|---|---|---|---|---|
| Control 1 | — | — | — | 2722 | 7.7% |
| Control 2 | — | — | — | 3248.86 | 3.3% |
| Control 3 | — | — | — | 2998.53 | 4.2% |
| O1S0 | 0.1% | — | — | 5003 | 5.7% |
| O2S0 | 0.5% | — | — | 8446 | 1.9% |
| O3S0 | 1% | — | — | 12003 | 4.8% |
| O4S0 | 2% | — | — | 14568 | 4.8% |
| O1S1K1 | 0.1% | SMA ® 1000I | 1% | 3737 | 3.0% |
| O1S1K2 | 0.1% | SMA ® 1000I | 10% | 4440 | 1.8% |
| O1S1K3 | 0.1% | SMA ® 1000I | 50% | 18855 | 3.0% |
| O1S1K4 | 0.1% | SMA ® 1000I | 100% | 26399 | 4.0% |
| O2S1K1 | 0.5% | SMA ® 1000I | 1% | 8022 | 6.5% |
| O2S1K2 | 0.5% | SMA ® 1000I | 10% | 31116 | 6.5% |
| O2S1K3 | 0.5% | SMA ® 1000I | 50% | 84085 | 2.2% |
| O2S1K4 | 0.5% | SMA ® 1000I | 100% | 114301 | 5.3% |
| O3S1K1 | 1% | SMA ® 1000I | 1% | 13294 | 5.9% |
| O3S1K2 | 1% | SMA ® 1000I | 10% | 58260 | 5.6% |
| O3S1K3 | 1% | SMA ® 1000I | 50% | 135558 | 7.2% |
| O3S1K4 | 1% | SMA ® 1000I | 100% | 136023 | 4.3% |
| O4S1K1 | 2% | SMA ® 1000I | 1% | 22152 | 9.8% |
| O4S1K2 | 2% | SMA ® 1000I | 10% | 94395 | 4.5% |
| O4S1K3 | 2% | SMA ® 1000I | 50% | 139708 | 3.8% |
| O4S1K4 | 2% | SMA ® 1000I | 100% | 137936 | 4.8% |
| O1S3K1 | 0.1% | SMA ® 3000I | 1% | 4037 | 4.2% |
| O1S3K2 | 0.1% | SMA ® 3000I | 10% | 5237 | 1.2% |
| O1S3K3 | 0.1% | SMA ® 3000I | 50% | 16769 | 6.3% |
| O1S3K4 | 0.1% | SMA ® 3000I | 100% | 26786 | 2.6% |
| O2S3K1 | 0.5% | SMA ® 3000I | 1% | 7111 | 7.3% |
| O2S3K2 | 0.5% | SMA ® 3000I | 10% | 28697 | 16.1% |
| O2S3K3 | 0.5% | SMA ® 3000I | 50% | 76364 | 5.6% |
| O2S3K4 | 0.5% | SMA ® 3000I | 100% | 77712 | 4.0% |
| O3S3K1 | 1% | SMA ® 3000I | 1% | 7731 | 13.5% |
| O3S3K2 | 1% | SMA ® 3000I | 10% | 53215 | 1.2% |
| O3S3K3 | 1% | SMA ® 3000I | 50% | 94342 | 3.5% |
| O3S3K4 | 1% | SMA ® 3000I | 100% | 103698 | 3.5% |
| O4S3K1 | 2% | SMA ® 3000I | 1% | 21183 | 8.5% |
| O4S3K2 | 2% | SMA ® 3000I | 10% | 76444 | 4.5% |
| O4S3K3 | 2% | SMA ® 3000I | 50% | 105171 | 4.7% |
| O4S3K4 | 2% | SMA ® 3000I | 100% | 107126 | 4.1% |
| O0s1k1 | — | SMA ® 1000I | 0.1%/1%* | 3405 | 7.0% |
| O0s1k2 | — | SMA ® 1000I | 2%/1%* | 3274 | 2.3% |
| O0s1k3 | — | SMA ® 1000I | 2%/10%* | 3275 | 13.3% |
| O0s1k4 | — | SMA ® 1000I | 2%/100%* | 3017 | 4.5% |
| O0s3k1 | — | SMA ® 3000I | 0.1%/1%* | 3273 | 8.0% |
| O0s3k2 | — | SMA ® 3000I | 2%/1%* | 3467 | 5.4% |
| O0s3k3 | — | SMA ® 3000I | 2%/10%* | 3291 | 6.4% |
| O0s3k4 | — | SMA ® 3000I | 2%/100%* | 3128 | 2.3% |

*Ratio based on a fiber percentage where the two percentages are multiplied together to give the percentage by fiber weight that is SI. Others represent % of OBA weight.

Figure 4:
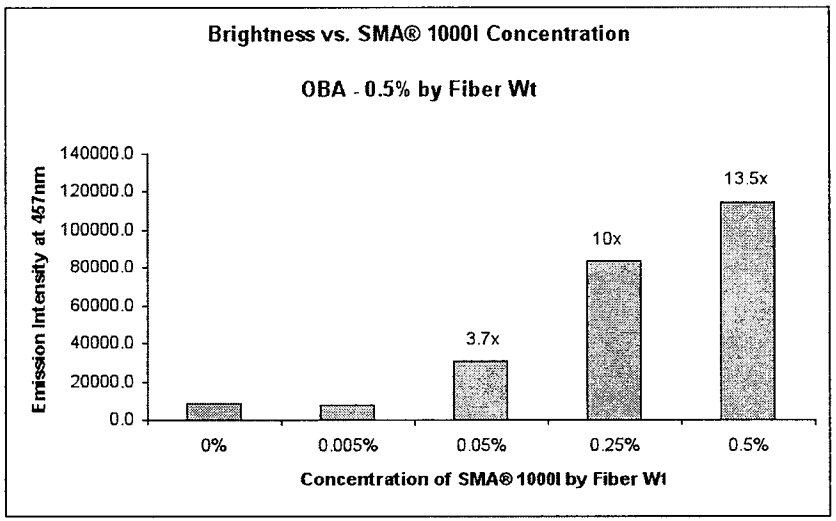
FIG. 4 presents a graph showing brightness.

The data set forth above indicate that addition of SI increases the emission intensity when combined with tetrasulfonated OBA, and that SMA® 1000I seems to be more effective for this purpose than the SMA® 3000I. FIG. 4 represents a subset of the data and showing the relative improvements from the inclusion of SI.

The results shown in this graph demonstrate that, at 0.5% OBA by fiber weight, it is possible to achieve a 13.5 times increase in brightness by using 0.5% SMA® 1000I by fiber weight. At a given OBA loading, use of the SI retention aid prepared according to these systems and methods improves retention of OBA onto fibers.

Example 7

Brightness of SI and Disulfonated OBA on Fibers

The experiment set forth in Example 5 was performed with Leucophor A Liquid (OBA) instead. Table 3 below shows the results.

The disulfonated OBA (Leucophor A) is known to retain better onto the fibers than the tetrasulfonated OBA (Leucophor T 100). In spite of this high affinity, a noticeable increase in brightness is seen when the disulfonated OBA is used in conjunction with the SI retention aid.

TABLE 3

| Sample | OBA Concentration (by fiber weight) | SI Type | SI Concentration (by OBA weight) | Intensity | Error |
|---|---|---|---|---|---|
| OA1s0 | 0.1% | — | — | 27822 | 2.5% |
| OA2s0 | 0.5% | — | — | 67024 | 2.8% |
| OA3s0 | 1% | — | — | 102379 | 6.9% |
| OA4s0 | 2% | — | — | 129840 | 2.6% |
| OA2s1k1 | 0.5% | SMA ® 1000I | 1% | 83962 | 1.7% |
| OA2s1k2 | 0.5% | SMA ® 1000I | 10% | 87708 | 11.0% |
| OA2s1k3 | 0.5% | SMA ® 1000I | 50% | 131943 | 8.1% |
| OA2s1k4 | 0.5% | SMA ® 1000I | 100% | 113237 | 4.1% |
| OA2s3k1 | 0.5% | SMA ® 3000I | 1% | 63553 | 13.6% |
| OA2s3k2 | 0.5% | SMA ® 3000I | 10% | 78555 | 4.2% |
| OA2s3k3 | 0.5% | SMA ® 3000I | 50% | 98706 | 8.8% |
| OA2s3k4 | 0.5% | SMA ® 3000I | 100% | 84595 | 6.3% |

Example 8

Handsheet Preparation

Handsheets were prepared using a Mark V Dynamic Paper Chemistry Jar and Handsheet Mold from Paper Chemistry Laboratory, Inc. (Larchmont, N.Y.). The functionalized slurry with SI and OBA added was diluted to 2 L and mixed with an overhead stirrer at 1100 rpm for 5 seconds, 700 rpm for 5 seconds, and 400 rpm for 5 seconds. The water was drained off and vacuum was applied to drain additional water. The subsequent sheet was then transferred off the wire of the handsheet mold, pressed and dried on a speed dryer at ~110° C.

Example 9

Brightness and Fluorescence Testing

Brightness testing was performed done using a Technidyne Micro S-5 Tappi Brightness Tester. A handsheet was folded in quadrants and 8 layers of the sample were used as a pad for testing. The brightness and fluorescence reported were an average of 4 spots on the handsheet, each from a different quadrant.

Example 10

Brightness of SI and Hexasulfonated OBA on Fibers

Figure 5:
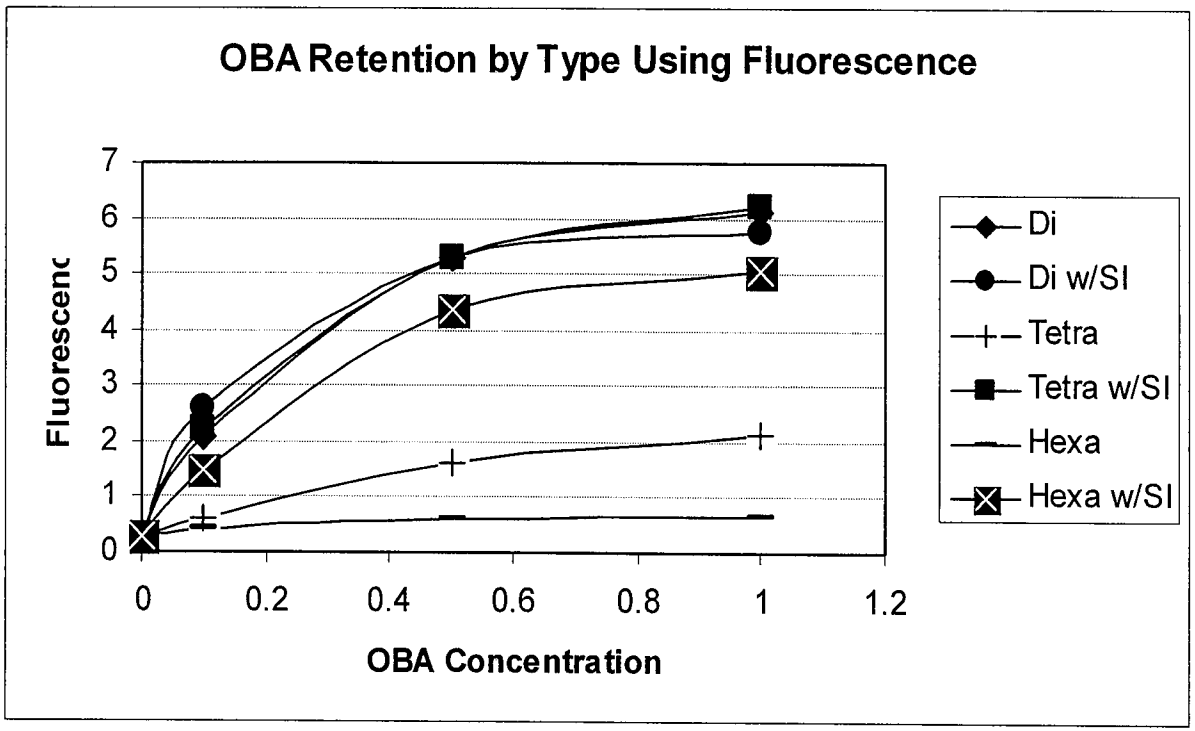
FIG. 5 presents a graph showing OBA retention.

Handsheets were made in accordance with Example 8, but using Hexasulfonated, tetrasulfonated and disulfonated OBA. Fluorescence was then tested using the protocol described in Example 9. FIG. 5 shows the results of Example 10. Due to the higher affinity of the di-sulfonated OBA for the fibers, there was no improvement in fluorescence using SI. However, we inferred from these results that the SI helped to retain the more watersoluble OBAs hexa and tetrasulfonated OBA onto the pulp.

Example 11

Measurement of Retention of OBA on Cellulose Fibers

Figure 6:
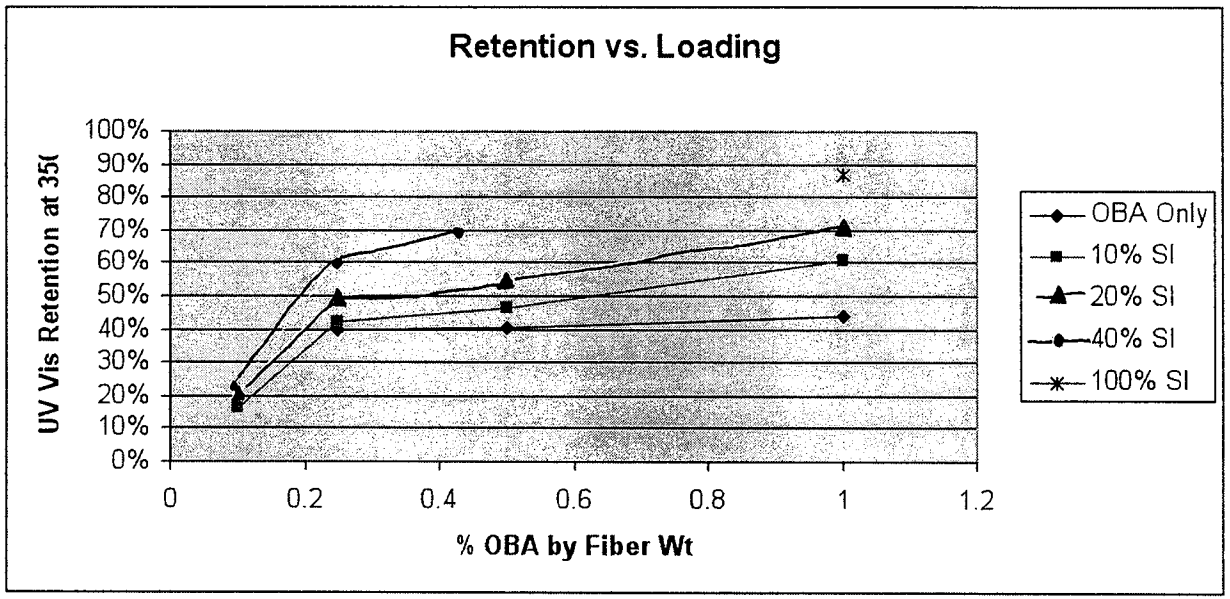
FIG. 6 presents a graph showing OBA retention.

Retention was measured by taking the effluent from the handsheet making process and centrifuging it at 3000 rpm for 20 min. It was then tested in the UV Vis spectrometer. The absorption peak height at 350 nm was compared to a control sample which contains the original OBA added to the sample. The relative decrease in peak height indicates the amount of the OBA retained on the pulp and thus no longer present in the effluent. FIG. 6 shows the retention of tetrasulfonated OBA as a function of SI loading (by weight of OBA). Substantial improvement in OBA retention was seen by the use of SI.

EQUIVALENTS

While specific embodiments of the subject invention have been discussed, the above specification is illustrative and not restrictive. Many variations of the invention will become apparent to those skilled in the art upon review of this specification.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the present invention.

The invention claimed is:

1. An optically enhanced paper-based material, comprising:

an optical brightening agent; and an additive comprising an aromatic portion, the aromatic portion associating with the optical brightening agent, the paper-based material exhibiting a higher capacity for the optical brightening agent relative to a paper-based material lacking the additive.

2. The paper-based material of claim 1, wherein the aromatic portion of the additive substantially associates with the optical brightening agent by a non-ionic interaction.

3. The paper-based material of claim 1, wherein the paper-based material does not exhibit a substantial color shift relative to a paper-based product containing the optical brightening agent and not containing the additive.

4. The paper-based material of any preceding claim 1, wherein the additive comprises a non-polymeric-containing additive.

5. The paper-based material of claim 1, wherein the additive comprises a polymer having a plurality of aromatic-containing units.

6. The paper-based material of claim 5, wherein the plurality of aromatic-containing units comprises a styrenic unit that is optionally substituted.

7. The paper-based material of claim 5, wherein the polymer comprises a copolymer.

8. The paper-based material of claim 7, wherein the copolymer comprises at least a styrene maleimide portion.

9. The paper-based material of claim 7, wherein the copolymer comprises at least a styrene maleic anhydride portion.

10. The paper-based material of claim 1, further comprising:

a fibrous matrix, wherein the additive comprises at least one fiber-associating functionality capable of associating the additive with the fibrous matrix.

11. The paper-based material of claim 10, wherein the additive renders the fibrous matrix substantially hydrophobic.

12. The paper-based material of claim 1, wherein the additive does not substantially quench fluorescence of the optical brightening agent.

13. The paper-based material of claim 1, wherein the additive comprises a filler particle.

14. The paper-based material of claim 13, wherein the filler particle is functionalized to exhibit association with a fibrous matrix of the paper-based material.

15. The paper-based material of claim 14, wherein the functionalized particle comprises a polycation coupled to the particle.

16. The paper-based material of claim 15, wherein the functionalized particle comprises an aromatic-containing polymer coupled to the polycation.

17. A method for increasing optical brightening agent retention in a fibrous product, comprising:

associating an additive comprising an aromatic portion with the optical brightening agent, the aromatic portion associating the optical brightening agent with the additive by a non-ionic interaction, whereby the retention of the optical brightening agent is increased.

18. The method of claim 17, wherein the step of associating the additive comprises inducing pi-bond interactions between the additive and the optical brightening agent.

19. The method of claim 17, further comprising:

preventing a substantial color shift in the fibrous product due to the presence the additive and the optical brightening agent.

20. The method of claim 17, wherein the fibrous product is a paper-based material.

21. The method of claim 20, further comprising:

associating the additive with a fibrous matrix of the paper-based material.

22. The method of claim 21, wherein the step of associating the additive comprises changing the pH of a papermaking mixture to increase attraction between the additive and the fibrous matrix.

23. The method of claim 21, wherein the step of associating the additive comprises using a polycation to couple the additive with the fibrous matrix.

24. The method of claim 21, further comprising:

increasing hydrophobicity of the fibrous matrix with at least a portion of the additive.

25. The method of claim 24, wherein the step of increasing hydrophobicity is performed before the step of using the additive to associate the optical brightening agent with the additive.

26. The method of claim 24, wherein the step of increasing hydrophobicity is performed after the step of using the additive to associate the optical brightening agent with the additive.

27. The method of claim 20, further comprising:

attaching at least a portion of the additive to a plurality of particles to form functionalized particles.

28. The method of claim 27, further comprising:

contacting the functionalized particles to the optical brightening agent.

29. The method of claim 28, further comprising:

adhering the functionalized particles to fibers of the paper-based material before the step of contacting the functionalized particles to the optical brightening agent.

30. The method of claim 28, further comprising:

adhering the functionalized particles to fibers of the paper-based material after the step of contacting the functionalized particles to the optical brightening agent.

31. The method of claim 27, wherein the step of attaching at least a portion of the additive comprises using a polycation to attach the additive to the plurality of particles.

32. The method of claim 17, wherein the fibrous product is selected from the group consisting of papers, textiles, or other nonwoven or woven materials containing natural or synthetic fibers.

* * * * *

UNITED STATES PATENT AND TRADEMARK OFFICE

CERTIFICATE OF CORRECTION

PATENT NO. : 8,475,630 B2
APPLICATION NO. : 12/761620
DATED : July 2, 2013
INVENTOR(S) : Lynn Reis, Gangadhar Jogikalmath and David S. Soane It is certified that error appears in the above-identified patent and that said Letters Patent is hereby corrected as shown below:

In the Claims

Column 15, Claim 4, line 10:
After "of" please delete "any preceding".

Column 16, Claim 19, line 6:
After "presence" please insert --of--.

Signed and Sealed this
Thirty-first Day of December, 2013

Margaret A. Focarino

Margaret A. Focarino
*Commissioner for Patents of the United States Patent and Trademark Office*